US009102899B2

(12) United States Patent
Bachmann et al.

(10) Patent No.: US 9,102,899 B2
(45) Date of Patent: Aug. 11, 2015

(54) ORGANIC COMPOUNDS

(75) Inventors: Jean-Pierre Bachmann, Wadenswil (CH); Mario Pesaro, Zurich (CH); Felix Flachsmann, Duebendorg (CH)

(73) Assignee: Givaudan SA, Vernier (CH)

( * ) Notice: Subject to any disclaimer, the term of this patent is extended or adjusted under 35 U.S.C. 154(b) by 1877 days.

(21) Appl. No.: 11/720,996

(22) PCT Filed: Dec. 6, 2005

(86) PCT No.: PCT/CH2005/000726
§ 371 (c)(1), (2), (4) Date: Aug. 1, 2007

(87) PCT Pub. No.: WO2006/060931
PCT Pub. Date: Jun. 15, 2006

(65) Prior Publication Data

US 2008/0306170 A1 Dec. 11, 2008

(30) Foreign Application Priority Data

Dec. 8, 2004 (GB) ..... 0426816.5
Sep. 12, 2005 (GB) ..... 0518559.0

(51) Int. Cl.
*A61Q 13/00* (2006.01)
*C11B 9/00* (2006.01)

(52) U.S. Cl.
CPC ..... *C11B 9/0065* (2013.01)

(58) Field of Classification Search
CPC ..... C11B 9/0065
USPC ..... 512/1, 6, 10, 8; 558/388; 424/76.1, 424/76.2; 510/102
See application file for complete search history.

(56) References Cited

U.S. PATENT DOCUMENTS 4,625,046 A 11/1986 Gebauer
4,791,098 A 12/1988 Martin et al.
5,389,608 A 2/1995 Levorse et al.
7,648,954 B2 * 1/2010 Saudan et al. ..... 512/6

FOREIGN PATENT DOCUMENTS

EP 1837581 A1 3/2008
WO 02059079 A1 8/2002

OTHER PUBLICATIONS

Murahashi et al. , Aldol and Michael Reactions of Nitriles Catalyzed by Cyclopentadienyl-ruthenium Enolate Complexes, Synlett, 2000, No. 7, 1016-1018.*
Search Report from the Patent Office in Great Britain dated Mar. 4, 2005 for Application GB0426816.5.
International Search Report dated Feb. 15, 2006 for Application PCT/CH2005/000726.
Written Opinion of the International Searching Authority for Application PCT/CH2005/000726.
Journal of the American Society vol. 54; Edwin C. Knowles and John B. Cloke; pp. 2028-2037.
Text of Chinese Office action for Cn 200580042243.0 dated Jul. 10, 2009.
Li Zhengyuan, "The Future of Application of Nitrile Compounds in the Perfume Industry", Fine Chemicals, 3 (1) 33-77, Jan. 31, 1986.

* cited by examiner

*Primary Examiner* — Savitha Rao
(74) *Attorney, Agent, or Firm* — Norris McLaughlin & Marcus PA

(57) ABSTRACT

The use of 2-phenyl-2-alkene nitriles as fragrance ingredients and fragrance applications comprising them. These fragrance applications can be e.g. perfumes, household products, laundry products, body care products and cosmetics.

3 Claims, No Drawings

ORGANIC COMPOUNDS

This is an application filed under 35 USC 371 of PCT/CH2005/000726.

The present invention refers to 2-phenyl-2-alkene nitrites and their use as fragrance ingredient.

In the fragrance industry there is a constant demand for new compounds that enhance or improve on odour notes, or impart new odour notes.

It has now been found that certain 2-phenyl-2-alkene nitrites constitute new powerful odorants. Although some 2-phenyl-2-alkene nitrites are known as intermediates (see for example U.S. Pat. No. 5,389,608), there is no indication in the literature that these intermediates, namely the α,β-unsaturated nitrites, have odour properties which make them suitable for the fragrance industry. The only indication with regard to the odour properties of certain 2-phenyl-2-alkene nitrites is given by E. C. Knowles et al. (Journal of the American Chemical Society (1932), 54, page 2028-2037) who discloses 2-phenyl-but-2-ene nitrile as a compound having a musty unpleasant odour.

Surprisingly it has been found that certain 2-phenyl-2-alkene nitrites are not only very suitable as fragrance ingredients because of their very pleasant floral, fresh, Rosacetol like odour notes but also because of their very low odour threshold, which is about 7 to 9 times lower in comparison to the saturated compounds. 2-Phenyl-2-alkene nitrites of the present invention therefore are much stronger than their saturated counterparts.

Accordingly the present invention refers in one of its aspects to the use of a compound of formula I as fragrance ingredient

I

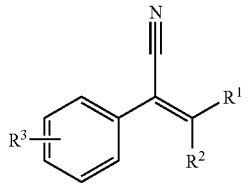

wherein $R^1$ and $R^2$ are independently H, $C_{1-8}$ alkyl, e.g. methyl, ethyl, propyl, iso-butyl, n-butyl, tert-pentyl, iso-pentyl, and n-pentyl, or $C_{2-8}$ alkenyl, e.g. vinyl, allyl, and 1-butenyl, with the proviso that at least one of the residues $R^1$ and $R^2$ is not hydrogen;

$R^3$ is H, methoxy, $C_{1-4}$ alkyl, e.g. methyl, ethyl or propyl, or $C_{2-4}$ alkenyl, e.g. vinyl or allyl; and the sum of the carbon atoms of the compound of formula I is ≤18, preferably between 11 and 16.

The compounds according to the present invention may contain one or more stereogenic units, such as chiral centres and/or E/Z-configurated double bonds, and as such may exist as a mixture of stereoisomers, or they may be resolved as isomerically pure forms. Resolving stereoisomers adds to the complexity of manufacture and purification of these compounds, and so it is preferred to use the compounds as mixtures of their stereoisomers simply for economic reasons. However, if it is desired to prepare individual stereoisomers, this may be achieved according to methodology known in the art, e.g. preparative HPLC and GC or by stereoselective synthesis.

Particular preferred compounds of formula I are 3-methyl-2-phenyl-but-2-ene nitrile, 3-ethyl-2-phenyl-pent-2-ene nitrile, (2E)-2-phenyl-oct-2-ene nitrile, 3-methyl-2-phenyl-pent-2-ene nitrile, 3-methyl-2-p-tolyl-but-2-ene nitrile, 3,7-dimethyl-2-phenyl-octa-2,6-diene nitrile, (2E)-5-methyl-2-phenyl-hexa-2,4-diene nitrile, 2-(2-methoxy-phenyl)-3-methyl-but-2-ene nitrile, and 2-(3-methoxy-phenyl)-3-methyl-but-2-ene nitrile.

Most preferred is 3-methyl-2-phenyl-but-2-ene nitrile because of its odour note, which is very close to that of rosacetol (trichloro-methyl-phenyl-carbinyl acetate).

The compounds according to the present invention may be used alone or in combination with known odourant molecules selected from the extensive range of natural and synthetic molecules currently available, such as essential oils, alcohols, aldehydes and ketones, ethers and acetals, esters and lactones, macrocycles and heterocycles, and/or in admixture with one or more ingredients or excipients conventionally used in conjunction with odourants in fragrance compositions, for example, carrier materials, and other auxiliary agents commonly used in the art.

The following list comprises examples of known odourant molecules, which may be combined with the compounds of the present invention:

- ethereal oils and extracts, e.g. oak moss absolute, basil oil, tropical fruit oils, such as bergamot oil and mandarine oil, mastic absolute, myrtle oil, palmarosa oil, patchouli oil, petitgrain oil, wormwood oil, lavender oil, rose oil, jasmin oil, ylang-ylang oil and sandalwood oil.
- alcohols, e.g. cis-3-hexenol, cinnamic alcohol, citronellol, Ebanol™, eugenol, farnesol, geraniol, menthol, nerol, rhodinol, Super Muguet™, linalool, phenylethyl alcohol, Sandalore™, terpineol and Timberol™ (1-(2,2,6-Trimethylcyclohexyl)hexanol-3).
- aldehydes and ketones, e.g. citral, hydroxycitronellal, Lilial®, methylnonylacetaldehyde, anisaldehyde, allylionone, verbenone, nootkatone, geranylacetone, α-amylcinnamic aldehyde, Georgywood™, hydroxycitronellal, Iso E Super®, Isoraldeine® (methylionone), Hedione®, maltol, methyl cedryl ketone, and vanillin.
- ether and acetals, e.g. Ambrox™, geranyl methyl ether, rose oxide and Spirambrene™.
- esters and lactones, e.g. benzyl acetate, cedryl actetate, γ-decalactone, Helvetolide®, γ-undecalactone, vetivenyl acetate, cinnamyl propionate, citronellyl acetate, decyl acetate, dimethylbenzylcarbinyl acetate, ethyl acetoacetate, ethyl acetylacetate, cis-3-hexenyl isobutyrate, linalyl acetate and geranyl acetate.
- macrocycles, e.g. ambrettolide, ethylene brassylate and Exaltolide®.
- heterocycles, e.g. isobutylchinoline.

The compounds of the present invention may be used in a broad range of fragrance applications, e.g. in any field of fine and functional perfumery, such as perfumes, household products, laundry products, body care products and cosmetics. The compounds can be employed in widely varying amounts, depending upon the specific application and on the nature and quantity of other odourant ingredients. The proportion is typically from 0.001 to 5 weight percent of the application. In one embodiment, compounds of the present invention may be employed in a fabric softener in an amount of from 0.001 to 0.05 weight percent. In another embodiment, compounds of the present invention may be used in fine perfumery in amounts of from 0.1 to 5 weight percent, more preferably between 0.1 and 2 weight percent. However, these values are given only by way of example, since the experienced perfumer may also achieve effects or may create novel accords with lower or higher concentrations.

Surprisingly it has been found that the compounds of formula I have the ability to inhibit or at least diminish the formation of prostaglandins in the skin, which makes them potentially suitable for skin soothing. Thus the compounds of formula I are particularly suitable for body care products and cosmetics, such as ointments, deodorants, and sun lotions, which are directly applied to the skin.

The compounds of the present invention may be employed into the fragrance application simply by directly mixing the fragrance composition with the fragrance application, or they may, in an earlier step, be entrapped with an entrapment material, examples of which include polymers, capsules, microcapsules and nanocapsules, liposomes, film formers, absorbents such as carbon or zeolites, cyclic oligosaccharides and mixtures thereof, or they may be chemically bonded to substrates, which are adapted to release the fragrance molecule upon application of an external stimulus such as light, enzyme, or the like, and then mixed with the application.

Thus, the invention additionally provides a method of manufacturing a fragrance application, comprising the incorporation of a compound of formula I as a fragrance ingredient, either by directly admixing the compound to the application or by admixing a fragrance composition comprising a compound of formula I, which may then be mixed to a fragrance application, using conventional techniques and methods.

As used herein, "fragrance application" means any products, such as fine fragrances, e.g. eau de perfumes and eau de toilettes; household products, e.g. detergents for dishwasher, surface cleaner; laundry products, e.g. softener, bleach, detergent; body care products, e.g. shampoo, shower gel; and cosmetics, e.g. deodorants, vanishing cremes, comprising an odorant. This list of products is given by way of illustration and is not to be regarded as being in any way limiting.

The compounds of formula I may be prepared by condensation of a benzyl cyanide of formula III with the corresponding carbonyl compound as shown in Scheme 1, wherein $R^1$, $R^2$ and $R^3$ have the same meaning as given above.

Scheme 1:

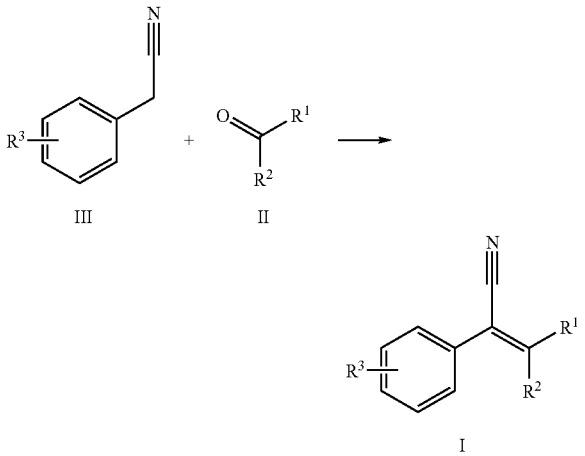

The benzyl cyanide (III) is dissolved in an excess of the corresponding carbonyl compound (II). Then a base, for example potassium t-butoxide, or potassium hydroxide, is added and the resulting mixture is heated to 50-100° C., preferably to 50-70° C. The reaction product (I) is isolated by standard extraction techniques known to the person skilled in the art and purified by distillation under reduced pressure.

The invention is now further described with reference to the following non-limiting examples.

EXAMPLE 1

3-Methyl-2-phenyl-but-2-ene nitrile

Benzyl cyanide (50.0 g, 0.43 mol) is dissolved in a mixture of acetone (150 ml) and methanol (20 ml) and then KOH (10 g, 0.15 mol) is added under stirring. After complete dissolution the brown mixture is heated to 65° C. (oil bath) during 90 min. The mixture is concentrated in a rotary evaporator, the residue is dissolved in toluene and washed 3 times with half saturated aq. NaCl-solution. The organic layer is dried over $MgSO_4$, the solvent removed under reduced pressure and the residue distilled over a short-path apparatus at 0.07 mbar. The fraction distilling at 77° C. is collected (33 g) and subjected to a fine distillation over a Widmer-column to yield 31.3 g (47%) of 3-methyl-2-phenyl-but-2-ene nitrile as colourless oil (b.p. 85° C./0.05 mbar).

$^{13}$C-NMR: 154.6 (s), 134.1 (s), 129.1 (d), 128.6 (d), 128.2 (d), 118.8 (s), 111.0 (s), 24.9 (q), 21.6 (q). MS: 157 (100, $[M]^+$), 142 (79), 129 (51), 115 (76).

Odour description: floral, Rosacetol, fresh, citrus, dry hay, tobacco.

EXAMPLE 2

(2E)-2-Phenyl-oct-2-ene nitrile

Sodium (27.6 g, 1.2 mol) is dissolved in methanol (550 ml) and benzyl cyanide (140.4 g, 1.2 mol) is added, followed by dropwise addition over 45 min. of hexanal (164.2 g, 1.44 mol), keeping the inside temperature between 20-25° C. The mixture is further stirred during 90 min. at room temperature, and then extracted 3 times with hexane. The organic layers are washed with water, 2 N aq. HCl-solution, then brine. The organic layer is dried over $MgSO_4$, the solvent removed under reduced pressure and the residue distilled over a short-path apparatus at 0.04 mbar. The fraction distilling at 114-121° C. is collected (172 g) and subjected to a fine distillation over a Widmer-column to yield olfactorily pure 2-phenyl-oct-2-ene nitrile (113 g, 44%) as a colourless oil (b.p. 113-115° C./0.03 mbar).

$^{13}$C-NMR: 147.1 (d), 133.2 (s), 128.8 (d), 128.7 (d), 125.5 (d), 116.5 (s), 115.7 (s), 32.0 (t), 31.2 (t), 28.2 (t), 22.3 (t), 13.8 (q). MS: 199 (18, $[M]^+$), 184 (3), 170 (4), 156 (3), 143 (15), 124 (100), 115 (35).

Odour description: fresh, green, jasmine, salicylate.

EXAMPLE 3

3-Methyl-2-phenyl-pent-2-ene nitrile

Butanone (45.0 g, 0.63 mol) is added to the mixture of benzyl cyanide (58.5 g, 0.50 mol) and sodium methoxide (30% in MeOH, 34.3 ml, 0.185 mol) and the resulting suspension is heated to 60° C. (oilbath) and stirred for 6 h at this temperature. The product is extracted with cyclohexane, washed with dilute $NaHCO_3$-solution and brine. The organic layer is dried over $MgSO_4$, the solvent removed under reduced pressure and the residue distilled over a short-path apparatus at 0.05 mbar. The fraction distilling at 90° C. is collected (45 g) and subjected to a fine distillation over a Widmer-column to yield olfactorily pure 3-methyl-2-phenyl-pent-2-ene nitrile (19 g, 22%) as a colourless oil (b.p. 102° C./0.05 mbar). (E/Z) ratio about 55:45.

$^{13}$C-NMR: 160.1/159.9 (s), 134.2/134.1 (s), 129.1/128.9 (d), 128.7/128.6 (d), 128.3/128.2 (d), 118.9/118.6 (s), 110.7/110.2 (s), 31.8/27.5 (t), 21.8/19.0 (q), 12.5/12.4 (q). MS: 171 (50, $[M]^+$), 156 (48), 129 (100), 115 (29).

Odour description: sweet, floral, green honey, salicylate, orange blossom.

EXAMPLE 4

3-Methyl-2-p-tolyl-but-2-ene nitrile p-Tolylacetonitrile (18.5 g, 0.14 mol) is dissolved in a mixture of acetone (50 ml) and methanol (6.7 ml) and KOH (3.33 g, 0.05 mol) is added. The resulting mixture is heated to 65° C. (oilbath) and stirred for 3 h. The volatiles are removed in a rotary evaporator, the residue is dissolved in toluene and washed 3 times with half saturated aq. NaCl-solution. The organic layer is dried over $MgSO_4$, the solvent removed under reduced pressure and the residue distilled over a short-path apparatus at 0.06 mbar. The fraction distilling at 77° C. is collected (11 g) and subjected to a fine distillation over a Widmer-column to yield 3.54 g (15%) of 3-methyl-2-p-tolyl-but-2-ene nitrile as colourless oil (b.p. 90-95° C./0.05 mbar).

$^{13}$C-NMR: 154.1 (s), 138.1 (s), 131.2 (s), 129.3 (d), 128.9 (d), 118.9 (s), 110.8 (s), 24.9 (q), 21.6 (q), 21.2 (q). MS: 171 (100, $[M]^+$), 156 (94), 129 (92), 115 (27).

Odour description: citrus, rosy, fruity, minty.

EXAMPLE 5

3,7-Dimethyl-2-phenyl-octa-2,6-diene nitrile

To the mixture of 6-methyl-hept-5-en-2-one (90.86 g, 0.72 mol) and benzyl cyanide (46.8 g, 0.40 mol) is added dropwise a 4 N solution of KOH in MeOH (25.0 ml, 0.10 mol). The resulting suspension is heated to reflux during 4.5 h. Then methanol is removed by distillation and the residue is washed with 6 N aq. HCl-solution, then water, sat. aq. $NaHCO_3$-solution and brine. The organic layer is dried over $MgSO_4$, the solvent removed under reduced pressure and the residue distilled twice over a Widmer column to yield 3,7-Dimethyl-2-phenyl-octa-2,6-diene nitrile (21.5 g, 24%, (E/Z) mixture) as a colourless oil (b.p. 122DC/0.1 mbar).

$^{13}$C-NMR: 158.3/158.1 (s), 134.3/134.1 (s), 133.3/133.1 (s), 129.1 (2 d), 128.7/128.6 (d), 128.2 (2 d), 122.4 (2 d), 118.9/118.7 (s), 111.4/111.2 (s), 38.6/34.3 (t), 26.6/26.2 (t), 25.7/25.6 (q), 22.2/19.7 (q), 17.7/17.5 (q). MS: 225 (4, $[M]^+$), 157 (52), 140 (7), 128 (11), 115 (15), 69 (100).

Odour description: floral, honey, cinnamon, sweet.

EXAMPLE 6

(2E)-5-Methyl-2-phenyl-hexa-2,4-diene nitrile

Sodium (9.2 g, 0.4 mol) is dissolved in methanol (130 ml) and benzylcyanide (46.8 g, 0.40 mol) is added, followed by the careful addition of a solution of 3-methyl-2-butenal (40.3 g, 0.48) in methanol (100 ml). The resulting suspension is stirred for 20 h at room temperature and then worked up following the procedure described in Example 2. The crude product is crystallized twice from hexane to yield 5-methyl-2-phenyl-hexa-2,4-diene nitrile (44.9 g, 61%), m.p. 66-67° C.

$^{13}$C-NMR: 148.0 (s), 138.1 (d), 133.8 (s), 128.9 (d), 128.6 (d), 125.5 (d), 123.1 (d), 117.3 (s), 110.5 (s), 26.9 (q), 19.4 (q). MS: 183 (31, $[M]^+$), 168 (100), 153 (17), 141 (19), 128 (11), 115 (26)

Odour description: powdery, cinnamone, benzaldehyde.

EXAMPLE 7

2-(2-Methoxy-phenyl)-3-methyl-but-2-ene nitrile

According to the procedure described by Example 1, o-methoxybenzylcyanide (18.6 g, 127 mmol) is condensed with acetone (50 ml) under addition of methanol (6.5 ml) and KOH (3.33 g, 50 mmol) to yield, after workup and distillation at 106-110° C./0.05 mbar, 2-(2-methoxyphenyl)-3-methyl-but-2-ene nitrile (1.7 g, 7%).

$^{13}$C-NMR: 156.9 (s), 155.6 (s), 131.0 (d), 130.1 (d), 122.6 (s), 120.5 (d), 118.4 (s), 111.3 (d), 107.1 (s), 55.6 (q), 24.2 (q), 21.5 (q). MS: 187 (100, $[M]^+$), 172 (59), 156 (27), 145 (61), 115 (48).

Odour description: citrus, hyacinthe, coumarin.

EXAMPLE 8

2-(4-methoxy-phenyl)-3-methyl-but-2-ene nitrile

According to the procedure described by Example 1, p-methoxybenzylcyanide (18.6 g, 127 mmol) is condensed with acetone (50 ml) under addition of methanol (6.5 ml) and KOH (3.33 g, 50 mmol) to yield, after workup and distillation at 111-113° C./0.05 mbar, 2-(4-methoxyphenyl)-3-methyl-but-2-ene nitrile (14.3 g, 18%).

$^{13}$C-NMR: 159.3 (s), 153.7 (s), 130.3 (d), 126.4 (s), 119.0 (s), 114.0 (d), 110.4 (s), 55.3 (q), 24.8 (q), 21.5 (q). MS: 187 (100, $[M]^+$), 172 (69), 115 (38).

Odour description: floral, anis, sweet.

EXAMPLE 9

3-ethyl-2-phenyl-pent-2-ene nitrile

The title compound was prepared according to the procedure described in Example 1, by reacting benzyl cyanide with 3-pentanone in the presence of a base.

$^{13}$C-NMR: 165.5 (s), 134.2 (s), 128.9 (d), 128.7 (d), 128.2 (d), 118.7 (s), 110.2 (s), 28.2 (t), 24.6 (t), 12.8 (q), 12.5 (q). MS: 185 (33, $[M]^+$), 170 (11), 156 (18), 143 (67), 129 (100), 115 (32).

Odour description: green, floral, rosy.

EXAMPLE 10

Evaluation of Odour

According to standard procedures known to the person skilled in the art, threshold values for volatile perfumery compounds were determined on a gas chromatograph equipped with a sniff port by a panel of trained individuals. The last concentration smelled by each individual was recorded as the individual threshold value expressed in ng (absolute amount of compound delivered at the sniff port). All compounds have been evaluated by the same panel. The couples (saturated and unsaturated compound) were evaluated on the same day. The results are listed in Table 1.

TABLE 1

| Compound | | Odour threshold |
|---|---|---|
| Example 2 | 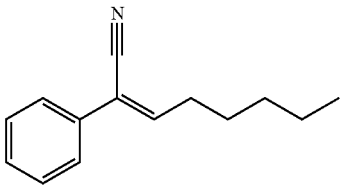 | 2 |
| Comparison Example 2A | 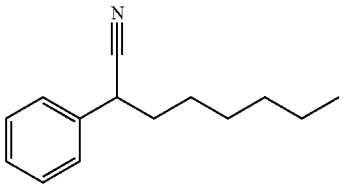 | 15 |
| Example 3 | 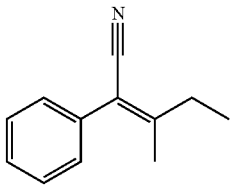 | 3 |
| Comparison Example 3A | 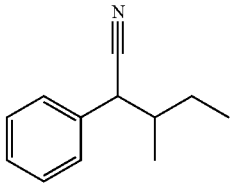 | 26 |

EXAMPLE 11

Preparation of a Perfume Composition for Shampoo

| Ingredients | Weight parts |
|---|---|
| Phenylethanol | 80 |
| Decanal | 5 |

-continued

| Ingredients | Weight parts |
|---|---|
| 10-Undecenol | 5 |
| Lauric Aldehyde | 5 |
| Ambrettolide | 65 |
| Bergamote Base | 130 |
| Ehtylene Brassylate | 250 |
| Citronellol | 50 |
| Georgywood | 18 |
| Geraniol | 50 |
| Iso E Super | 160 |
| Lilial | 150 |
| Ylang Ylang Ess. | 16 |
| Dipropylene glycol | 16 |
| Total | 1000 |

Substitution of Dipropylene glycol in this formula by 16 weight parts of 3-methyl-2-phenyl-but-2-ene nitrile of Example 1 enhances its floral-rosy aspect and renders it radiant and substantive.

The invention claimed is:

1. A method of imparting Rosacetol like odour notes to a fragrance application, comprising the step of incorporating a compound of formula I

I

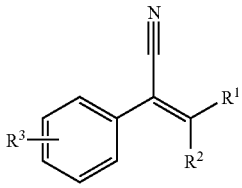

wherein: each of $R^1$ and $R^2$ is $CH_3$ and $R^3$ is H, wherein the sum of the carbon atoms of the compound of formula I is ≤18, into a base material.

2. A method according to claim 1 wherein the fragrance application is selected from the group consisting of perfumes, household products, laundry products, body care products and cosmetics.

3. A method according to claim 1, wherein the compound of formula I is 3-methyl-2-phenyl-but-2-ene nitrile, and the fragrance application is selected from the group consisting of perfumes, household products, laundry products, body care products and cosmetics.

* * * * *